United States Patent [19]

Kemp

[11] 4,142,465

[45] Mar. 6, 1979

[54] ROTARY WHEEL PRINTING MACHINE

[75] Inventor: John Kemp, Liverpool, England

[73] Assignee: Lawtons of Liverpool Limited, London, England

[21] Appl. No.: 794,078

[22] Filed: May 5, 1977

[30] Foreign Application Priority Data

May 10, 1976 [GB] United Kingdom ..... 19102/76

[51] Int. Cl.[2] ..... B41F 17/26

[52] U.S. Cl. ..... 101/330; 101/350

[58] Field of Search ..... 101/35, 329, 330, 331, 101/350; 74/416, 209, 194, 202, 206

[56] References Cited

U.S. PATENT DOCUMENTS

| | | | |
|---|---|---|---|
| 256,395 | 4/1882 | Smith | 74/194 |
| 376,592 | 1/1888 | Gibbes, Jr. | 74/194 X |
| 585,075 | 6/1897 | Barry | 101/350 X |
| 659,504 | 10/1900 | Baylor | 74/416 X |
| 724,480 | 4/1903 | Kennedy | 74/194 X |
| 948,933 | 2/1910 | Moldenhauer | 74/194 |
| 970,839 | 9/1910 | Lange | 101/37 |
| 1,130,365 | 3/1915 | Altheide | 74/194 X |
| 2,838,953 | 6/1958 | Cone | 74/209 X |
| 3,021,783 | 2/1962 | Casey | 101/329 X |
| 3,260,193 | 7/1966 | Mann | 101/35 |
| 3,394,651 | 7/1968 | Ochs | 101/35 |

*Primary Examiner*—Clifford D. Crowder

*Attorney, Agent, or Firm*—Kenyon & Kenyon, Reilly, Carr & Chapin

[57] ABSTRACT

A printing machine comprises a rotary print drum adapted to receive type and a rotary transfer roller located adjacent to the drum for transferring ink from an ink supply to type mounted on the drum. A transfer drive couples the drum to the transfer roller so that rotation of the drum effects rotation of the roller, the transfer drive comprising roller means arranged to contact both an end surface of the drum and an end surface of the transfer roller.

9 Claims, 6 Drawing Figures

FIG. 2.
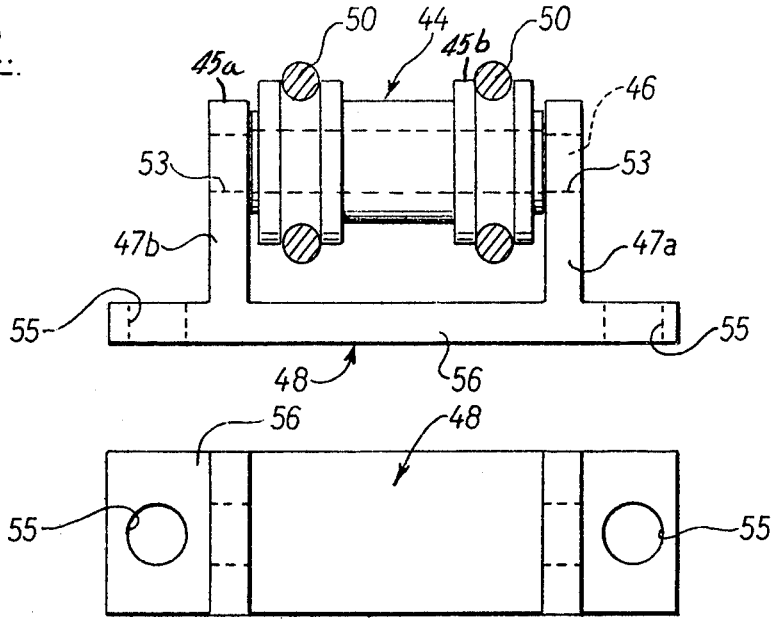
FIG. 3.
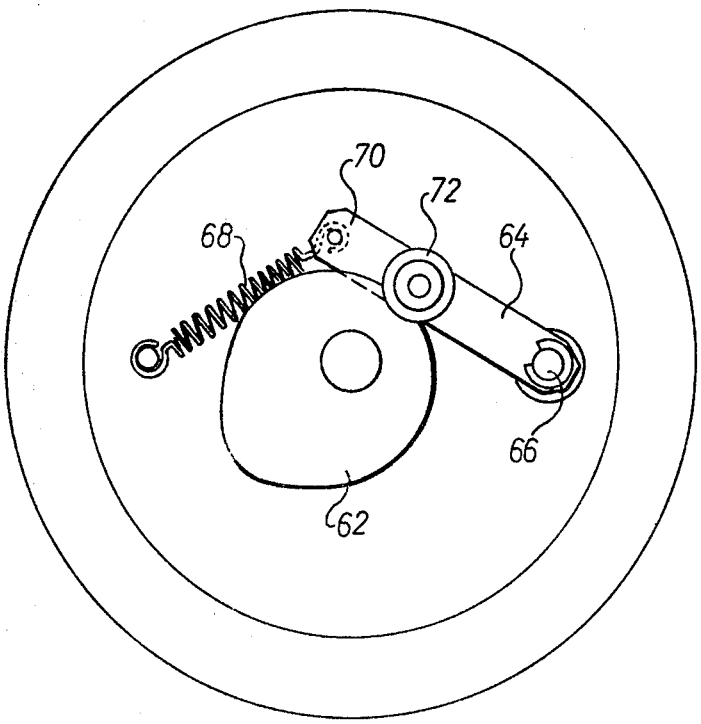
FIG. 4.

ROTARY WHEEL PRINTING MACHINE

This invention relates to printing machines and is particularly concerned with the type of printing machines used for printing package wrappers, cartons and other like articles.

One such known printing machine comprises a rotary print drum on which type can be mounted and an ink transfer roller arranged adjacent to the drum such that the axes of the drum and the transfer roller are parallel. In use, the transfer roller rotates collecting ink from an ink pad supplied with ink from an ink source and applying the ink to type mounted on the drum. The drum also rotates to bring the type firstly into contact with the transfer roller and then into contact with the article to be marked. Rotation of the transfer roller is achieved by drive means which couple the drum to the transfer roller such that the drum drives the transfer roller. These drive means include a pair of meshed gear wheels received on two shafts, which carry the drum and transfer roller respectively, and a solenoid operated control device which permits the drum, and thus the transfer roller, to rotate only intermittently.

Such printing machine is relatively costly to produce in view of its complexity and has the further disadvantage of being relatively bulky. The arrangement of the machine drive components is such that printing cannot take place in a confined area since any space accessible to the drum must be sufficiently large to accommodate the drive means also.

One aim of this invention is to provide a compact printing machine, another aim being the provision of a printing drum which is accessible to confined regions for printing. Thus the invention seeks to produce a new and compact drive means coupling the drum to an ink transfer roller. Further aims include the provision of a printing machine which is relatively cheap and simple to manufacture and whose upkeep is also relatively easy.

According to the present invention, a printing machine includes a rotary print drum adapted to receive type, a rotary transfer roller located adjacent to the drum for transferring ink from an ink supply to type mounted on the drum, and a transfer drive comprising roller means or such like arranged to contact an end surface of the drum and an end surface of the transfer roller whereby rotation of the drum effects rotation of the transfer roller. The roller means may, for example, be a single roller or two rigidly connected wheels rotatable about an axis perpendicular to the axis of the drum and are advantageously spring biassed against the drum and transfer roller to ensure that driving contact is maintained. In the case of a single roller, a pair of friction rings is preferably provided on the roller for engaging the drum and transfer roller, respectively.

Alternatively, however, the transfer drive may be in the form of a gear arrangement, the drum and transfer roller being provided with teeth adapted to engage two gear wheels mounted on a rotatable shaft.

Advantageously, the roller means is mounted on a support to form a sub-assembly which is detachable from the remainder of the machine for servicing purposes.

The invention is described further, by way of example, with reference to the accompanying drawings, in which:

FIG. 2 is a side elevation of the transfer drive roller of the machine of FIG. 1, with its rubber friction rings shown in section;

FIG. 3 is a plan view of the mechanism of FIG. 2 with the roller removed;

FIG. 4 is a section through the printing drum of the machine of FIG. 1,

Figure 1:
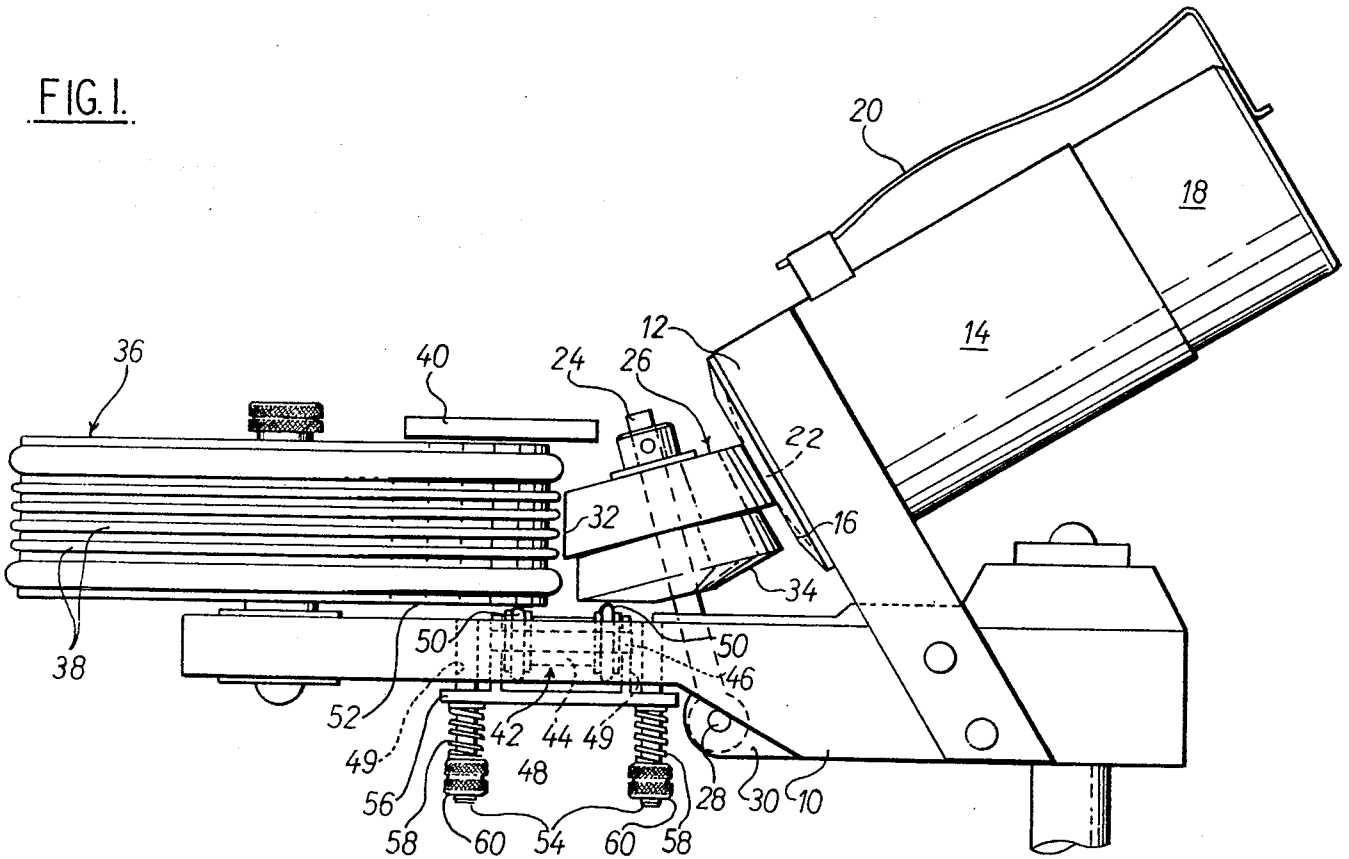
FIG. 1 is a side elevation of one embodiment of a printing machine constructed in accordance with the present invention.

The printing machine shown in FIG. 1 has a base 10 which carries a bracket 12 fixedly holding a hollow support cylinder 14 in a position inclined to the base 10. The support cylinder 14 has an annular plate 16 partially closing the end adjacent the base 10 and is open at the other end. A replaceable ink cartridge 18 is received within the support cylinder 14 and is retained by means of a spring clip 20, or other spring retainer, mounted on the cylinder 14 and engaging one end of the cartridge 18. The other end of the cartridge 18, which carries an ink pad 22, rests against the annular plate 16.

Located adjacent the support cylinder 14 and freely journalled on a shaft 24 mounted on the base 10 is an ink transfer roller 26. The base end of the shaft 24 is mounted on an axle 28 provided on a fitting 30 screwed to the base 10, arrangement being such that the shaft 24 is inclined relative to the base 10 and that the angle of inclination is freely adjustable.

The transfer roller itself has a frusto-conical surface 32 which contacts the ink pad 22 and a shallow frusto-conical, or annular drive surface 34. Preferably, the roller is biassed in a direction towards the base 10 by means of a helical spring (not shown) on the shaft 24.

A substantially freely rotatable drum 36 is mounted on the base 10 adjacent to the ink transfer roller 26 and with its axis perpendicular to the base 10. The drum 36 includes a plurality of circumferentially extending ribs 38 which interlock with similar ribs or claws on the reverse of type (not shown) mounted on the drum for printing. Upon rotation of the drum 36, such type is brought into contact with the surface 32 of the ink transfer roller 26 just sufficiently to receive ink transferred from the ink pad 22 by rotation of the roller 26. The spring loading and mounting of the roller 26 allows this roller to accommodate irregularities which may arise, for example, if the drum is not concentrically mounted.

Furthermore, the drum has on its upper end surface a skid device or wheel 40, which may be used to prevent continued rotation of the drum at the end of a type sequence. It will be appreciated that the skid device is not essential and may indeed be otherwise situated.

As apparent from the drawing, the positioning and axial length of the drum are such that it can gain access to relatively confined areas for printing purposes.

A driving connection between the drum 36 and the ink transfer roller 26 is provided by transfer mechanism 42, the main components of which are shown in FIGS. 2 and 3. In the present instance, the transfer mechanism 42 comprises a generally cylindrical roller member 44 rotatably supported on an axle 46 extending between the two arms 47*a*, 47*b* of a yoke 48. The roller member 44 has enlarged diameter portions 45*a*, 45*b* adjacent its two ends each of which has a peripheral groove of semi-circular cross-section for receiving rubber friction rings or tyres 50. The yoke is received within a rectangular opening in the base 10 and is arranged such that the rings or tyres 50 adjacent the axial ends of the member 44 run on an end surface 52 of the drum 36 and the drive surface 34 of the transfer roller 26, respectively. Two screws 54 extending through apertures 55 in the base 56 of the yoke 48 and into screw-threaded bores 49 in the base 10 maintain the yoke in position with the rings or tyres 50 engaging the surfaces 52, 34 and allow the yoke to be removed from the support 10 for replacement of the rings or tyres 50 when the latter are worn. In addition, two helical springs 58 acting between the base 56 of the yoke and the heads 60 of the screws 54 bias the roller member upwards so that the rings or tyres 50 are spring loaded against the surfaces 52, 34. The spring biassing of the roller member serves to accommodate a certain amount of wear of the rings or tyres 50 and promotes a firm driving connection.

Instead of the roller member 44, a cylindrical roller may be arranged on the shaft 46 with its cylindrical surface contacting both the surface 52 and the surface 34. Alternatively, the roller member may be replaced by two rigidly inter-connected friction wheels occupying the axial positions, on the shaft 46, of the rings or tyres 50. Another possibility is for the member 44 to be fixed on the shaft 46 and for the shaft 46 to be rotatably received in two recesses 53 in the yoke arms 47*a*, 47*b*. To strengthen the arrangement, the shaft may be made of metal and the recesses 53 may be provided with respective ball races.

An optional feature of the machine is shown in FIG. 4. Fixedly mounted on the axle of the drum 36 is a cam 62 which, in use, serves to position the drum correctly at the beginning of each printing operation. This is achieved as follows:

An arm 64 is mounted on an inner surface of the drum in such a manner that the arm can rotate about its bearings 66. A spring 68 is mounted between a free end 70 of the arm and a surface of the drum and continually urges a freely rotatable wheel or roller 72 mounted on the arm into contact with the cam surface of the cam 62. This causes the drum, which is freely rotatable on its axle, to move into the position shown, in the absence of any external force provided, for example by contact of the drum with the article to be printed during actual printing. The illustrated cam has a 360° action but it may equally well have, for example, a 90° to 180° action. It will be appreciated that the cam arrangement is a desirable feature when intermittent printing is required but when printing is to be effectively continuous the arrangement may be omitted from the machine without greatly impairing its operation.

Figure 5:
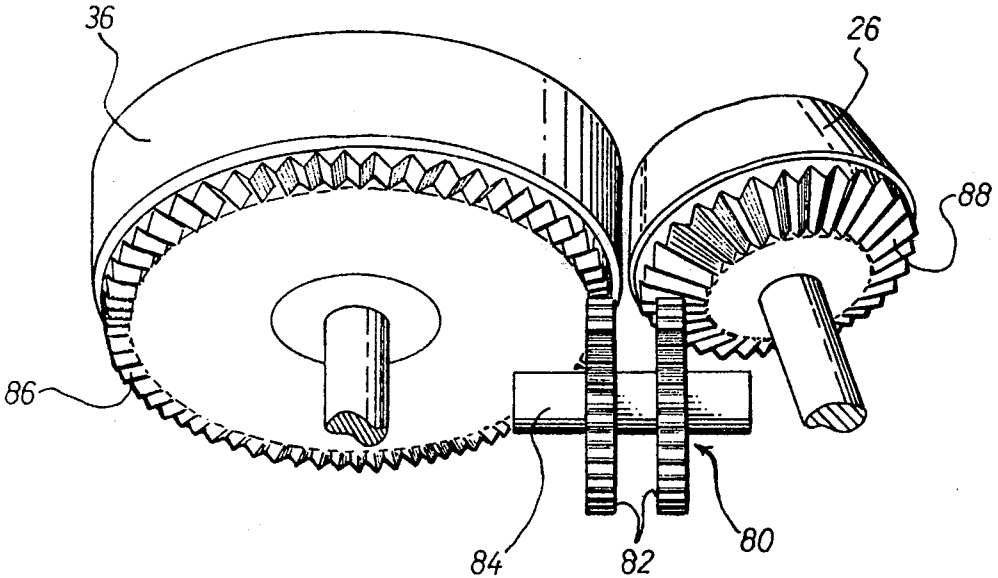
FIG. 5 is a perspective view of a portion of a second printing machine having a modified transfer drive roller.
Figure 6:
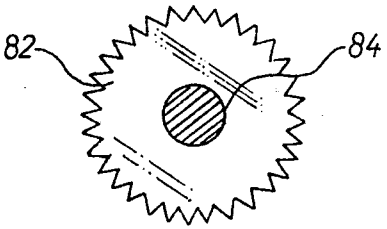
FIG. 6 is an end view of the roller in FIG. 5.

The arrangement shown in FIGS. 5 and 6 differs from that of FIGS. 1 to 3 only in the driving connection between the drum 36 and transfer roller 26 and like parts are denoted by the same numerals. In this instance, the roller member 44 is replaced by a roller member 80 comprising two toothed wheels 82 rigidly mounted on a shaft 84. The shaft 84 is rotatably received in the two recesses 53 in the yoke 48, the yoke being mounted as shown in FIG. 1 to bias the two wheels 82 into engagement with the surfaces 52, 34 of the drum 36 and transfer roller 26. In order to provide a positive connection between the surfaces 52, 34 and the sheels 82, these two surfaces are each provided with an annular knurled ring as shown in FIG. 5.

Such a positive connection is advantageous in certain applications of the printing machine when the rings or tyres 50 might tend to slip. The wheels 82 may be made of nylon for some applications but these tend to wear under heavy use and so for more strenuous applications it is preferable to use brass for the wheels 82.

I claim:

1. A printing machine comprising a frame, an ink reservoir carried by said frame, a print drum having an end surface, means rotatably supporting said print drum on said frame with the axis of rotation thereof extending substantially normal to said frame, a transfer roller having an ink transfer surface extending about the periphery thereof and an end surface, a shaft extending between said ink reservoir and said print drum, means rotatably mounting said transfer roller about the axis of rotation thereof on said shaft with the ink transfer surface disposed between said ink reservoir and said print drum for transferring ink from said reservoir to said print drum and with said transfer roller end surface extending radially with respect to the axis of rotation of said print drum, means for pivotably mounting said shaft to said frame such as that said shaft is inclined with respect to said frame and toward said print drum and is movable with said transfer roller between said print drum and said ink reservoir, and a transfer drive for coupling said print drum to said transfer roller for rotating the transfer roller in response to rotation of the print drum, said transfer drive including a support mounted on said frame, and roller means rotatably carried by said support, said roller means being in direct rolling contact with both said end surface of said print drum and said end surface of said transfer roller, the direct rolling contact of the roller means enabling the surface speed of the transfer roller to be substantially equal to the surface speed of the print drum.

2. A machine according to claim 1 further comprising spring means acting on said support to bias said roller means continually against each of said end surfaces.

3. A machine according to claim 1 further comprising means for releasing said support from said frame whereby said support forms a detachable sub-assembly of said frame.

4. A machine according to claim 1 wherein said frame contains an opening receiving said support, said support comprising a yoke having two arms which carry said roller means.

5. A machine according to claim 1 wherein said roller means frictionally engage said end surfaces.

6. A machine according to claim 5 wherein said roller means comprise a generally cylindrical member, and a pair of friction rings which are carried by said member and each of which engages a respective one of said end surfaces.

7. A machine according to claim 1 wherein said roller means positively engage said end surfaces.

8. A machine according to claim 7 wherein each of said end surfaces is provided with a knurled annular ring, and wherein said roller means comprises a shaft, and a pair of toothed wheels which are carried by said shaft and each of which engages respective one of said knurled annular rings.

9. A machine according to claim 1 wherein said roller means comprises a pair of rollers and a rotatable shaft to which the rollers are connected at a predetermined distance therebetween, the point of engagement in direct rolling contact of each roller with a different one of the transfer roller and the print drum enabling the surface speed of the transfer roller to be substantially equal to that of the print drum.

* * * * *

UNITED STATES PATENT AND TRADEMARK OFFICE

CERTIFICATE OF CORRECTION

PATENT NO. : 4,142,465

DATED : March 6, 1979

INVENTOR(S) : John Kemp

It is certified that error appears in the above-identified patent and that said Letters Patent are hereby corrected as shown below:

Column 3, line 47 - delete "to" and insert --or--

Column 3, line 64 - delete "sheels" and insert -- wheels --

Column 4, line 21, delete "as" after --such--

Signed and Sealed this

*Twenty-fifth* Day of *September 1979*

[SEAL]

*Attest:*

*Attesting Officer*

LUTRELLE F. PARKER

*Acting Commissioner of Patents and Trademarks*